United States Patent [19]

Comfort

[11] 4,448,292

[45] May 15, 1984

[54] KNOCKDOWN SUITCASE

[76] Inventor: Yacov Comfort, 4 Graetz St., Holon, Israel

[21] Appl. No.: 226,137

[22] Filed: Jan. 19, 1981

[30] Foreign Application Priority Data

Jul. 7, 1980 [IL] Israel ..... 60509

[51] Int. Cl.[3] ..... A45C 3/02; A45C 7/00; B65D 8/00

[52] U.S. Cl. ..... 190/107; 190/900; 220/4 F

[58] Field of Search ..... 190/17, 21, 41 R, 49, 190/50, 53, 54, 107; 220/4 F

[56] References Cited

U.S. PATENT DOCUMENTS 3,371,757 3/1968 Jamison et al. ..... 190/49
3,730,309 5/1973 Hamann et al. ..... 190/49
3,738,458 6/1973 Yount ..... 190/49
3,962,010 6/1976 Riou et al. ..... 190/49 X
4,002,233 1/1977 Page, Jr. ..... 220/4 F X

FOREIGN PATENT DOCUMENTS 289841 6/1967 Australia ..... 190/17
2615447 10/1977 Fed. Rep. of Germany ..... 220/4 F

*Primary Examiner*—William Price
*Assistant Examiner*—Sue A. Weaver
*Attorney, Agent, or Firm*—Wolf, Greenfield & Sacks

[57] ABSTRACT

A suitcase which is supplied to the customer completely dismantled consisting of flat top and bottom plates, of front and back profiled strips and side walls including the corners of the suitcase made by casting or molding. Grooves are provided in the front and back strips and side walls into which the top and bottom plates are inserted when the suitcase is set up.

4 Claims, 4 Drawing Figures

4
1
6'
31
27
28
26
5'
26
22
6
4'
32
29
III
3'
II
II
30
21
III
3
5
2

KNOCKDOWN SUITCASE

The present invention concerns a suitcase having a novel construction, it being understood that the term suitcase in the context of the present application comprises also attaché cases, cosmetic cases and the like.

Suitcases are generally manufactured in a number of countries only and these export them to the various customer countries. It goes without saying that the space required for shipping suitcases is large and is not exploited since the inside of the suitcases are empty during shipment. Furthermore during use all suitcases are damaged more or less. If the damage is large the entire suitcase has to be discarded and replaced by a new one. Moreover, suitcases having stiff walls are generally molded or press-formed depending on the material from which they are made. This requires expensive, heavy machinery and equipment.

It is therefore the object of the present invention to provide a suitcase of novel construction which is supplied to the customer country completely dismantled so that minimum shipping space is required, and is adapted to be assembled in the customer country without any particular tools.

It is a further object of the present invention to provide a suitcase made of parts which are cheap and easy to manufacture.

Furthermore, owing to the novel construction any damaged part of the suitcase can be easily replaced without having to discard the entire suitcase.

The invention consists in a suitcase comprising flat top and bottom plates which are held in grooves provided in the front, back and sides of the case, the front and back being made of profiled strips, while the side walls are made by casting or molding, said side walls including the corners of the case and being adapted to receive, besides the said plates, the ends of said front and back profiles.

The dimensions of the profiles, the case parts and all the grooves are such that the entire suitcase is held together by friction. However, if desired, a suitable adhesive may be provided, to hold said plates within said grooves and/or to hold the end of the profiles in said corners.

The invention is illustrated, by way of example only, in the accompanying drawings in which.

Figure 1:
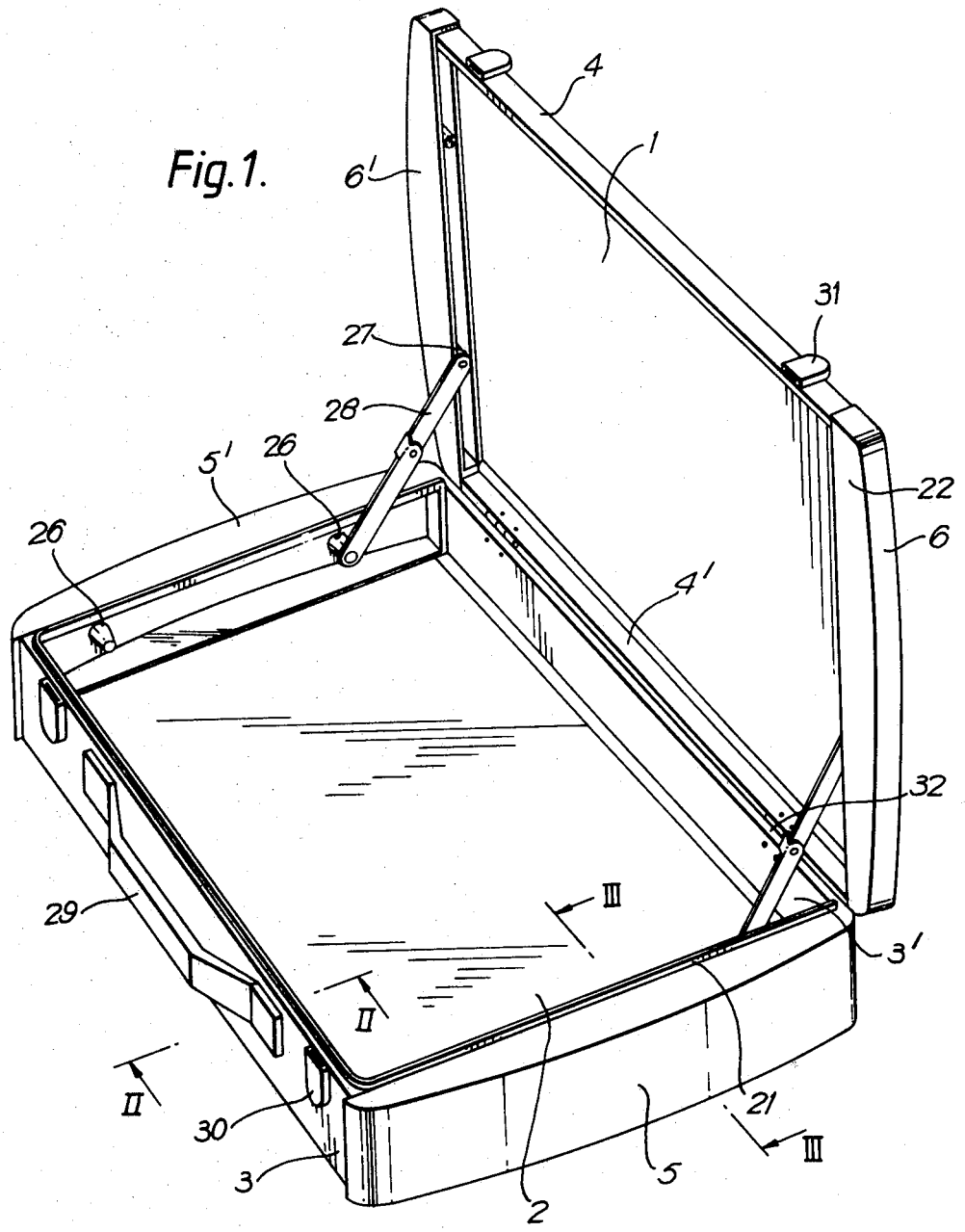
FIG. 1 is a perspective view of a suitcase constructed according to the invention in open condition.
Figure 2:
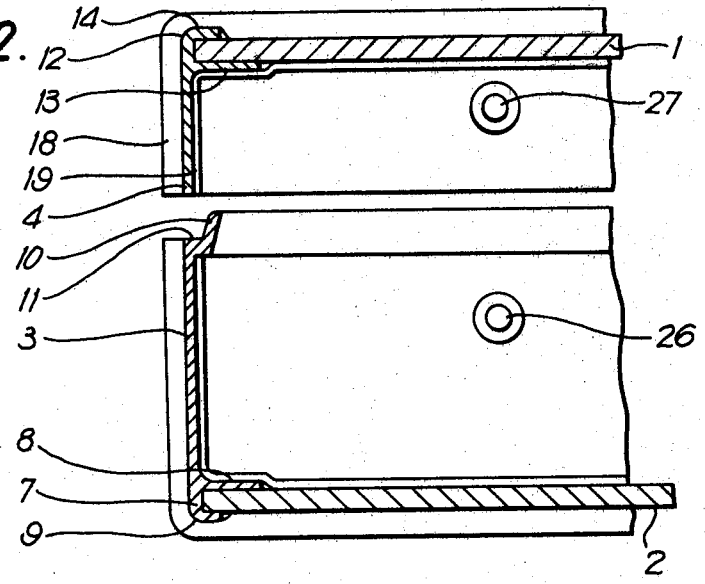
FIG. 2 is a partial cross section on line II—II of the suitcase when almost closed.
Figure 3:
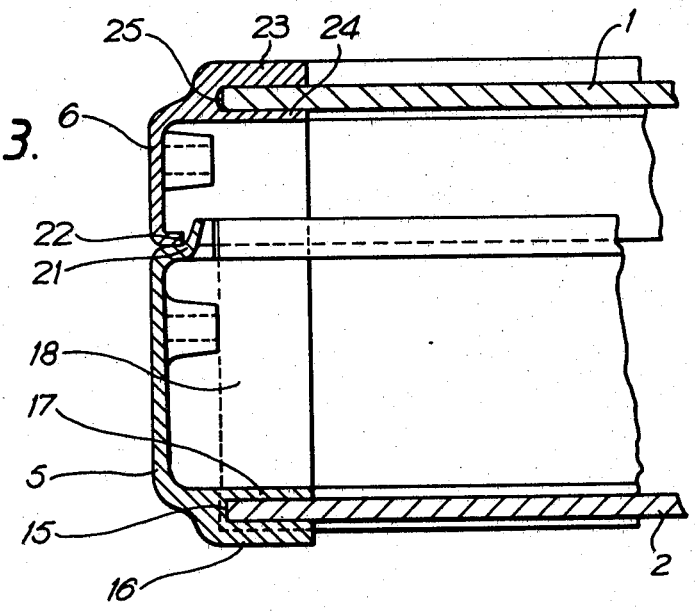
FIG. 3 is a partial section taken on line III—III of FIG. 1 in the closed condition of the suitcase.
Figure 4:
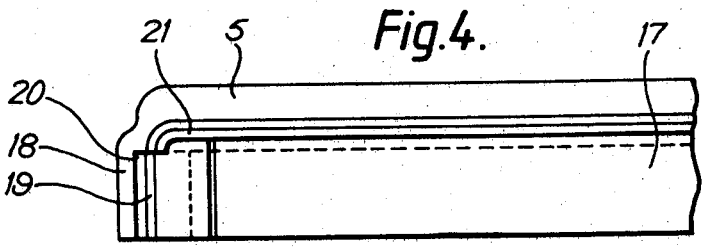
FIG. 4 is a partial plan view of the side part bottom illustrating the included corner.

As shown in FIG. 1 the suitcase according to the invention comprises a flat top plate 1, a flat bottom plate 2, a bottom front and rear part 3, 3' respectively, a top front and rear part 4, 4' respectively, bottom side parts 5, 5' and top side parts 6, 6'. In the following description the front parts 3 and 4 and side parts 5 and 6 will be described only, it being understood that these parts are identical with their respective opposite parts, i.e. the back parts 3', 4', respectively, and the opposite side parts 5', 6', respectively.

Front parts 3 and 4 are constituted by strips, preferably of extruded metal, but if desired may be of any suitable plastics or other material and be produced by any suitable process other than extrusion. Strip 3 comprises at its bottom a short, rounded-off flange 7 and spaced therefrom and facing the same direction a straight flange 8, so that a groove 9 is formed between flanges 7 and 8 along the entire length of said strip. This groove 9 is engaged by the front edge of bottom plate 2. The top of strip 3 is off-set by a flange 10, providing a shoulder 11 against which the bottom edge of strip 4 rests. Strip 4 is likewise preferably extruded, having a rounded off short top flange 12 and spaced below it a straight flange 13. A groove 14 is formed between flanges 12 and 13 to receive the front edge of top plate 1.

At the back of the suitcase strips 3' and 4' are provided which are in mirror symmetry to strips 3 and 4 and are of identical construction, the grooves between their flanges being adapted to receive the back edge of plates 2 and 1 respectively.

The bottom side wall 5 of the suitcase shown in FIG. 1 is made by casting or molding of plastics, metal or any other suitable material. It comprises a bottom groove 15 formed along the side between a bottom flange 16 and internal flange 17 spaced above it to receive the side edge of bottom plate 2. Both ends of side wall 5 include the respective corner, said corners being formed by a flange 18 extending at right angles to wall 5 for its entire height and having a parallel flange 19 spaced at a small distance therefrom. Between flanges 18 and 19 a groove 20 is formed adapted to receive the ends of strip 3. The top edge of side wall 5 is off-set and provides a shoulder 21 to receive the bottom flange 22 of top side wall 6. At the top of the side wall part 6 a flange 23 at the right angles thereto is provided, a second parallel flange 24 being spaced below it, whereby a groove 25 is formed to receive the side edge of top plate 1.

Part 6 is molded or cast in a manner similar to part 5 and also includes the corners, i.e. flanges similar to flanges 18, 19 (not shown) to receive the end of strip 4. Side wall parts 5, 6 are made integral with bosses 26, 27 respectively and are adapted to receive mounting means, i.e. screws or the like for a hinged stay 28 as known per se in suitcases. Front plate 3 is provided with a handle 29 and one part 30 of a lock on either side of handle 29, the other part of the lock 31 being mounted on strip 4. Between back parts 3' and 4' hinges indicated at 32 are mounted. All the fittings, i.e. the handle, lock parts and hinges may be attached to the strips 3, 4, 3', 4', respectively, in that these fittings are made integral with prongs which extend through suitable holes in said profiles and can be bent on the inside of the profiles, as known.

It can be seen that since parts 3, 3' and 4, 4' respectively are identical (except for their attached fittings) and side walls 5, 5' and 6, 6' are likewise identical, the assembly of these parts is extremely simple. The profiles and the top and bottom plates may be produced in any lengths and may simply be cut to size by suitable shearing means. The suitcase can be shipped in the dismantled condition and can be assembled in the customer country.

Although, owing to their manufacture, the dimensions of the parts according to the invention are such that these parts will be held together by friction, it is preferable to add a suitable adhesive, particularly in grooves 20 to assure that parts 3 and 4 will be fixedly assembled to parts 5, 5' and 6, 6' respectively.

The invention is applicable to all types of suitcases and can be provided with any desired type of interior fittings, as known in suitcases.

Furthermore, the suitcase may have any desired design, e.g. slanted sides, the side parts 5, 5', 6, 6' being molded accordingly.

I claim:

1. A suitcase comprising a bottom part having a bottom panel, two sidewalls, a front panel and a back panel, a top part having a top panel, two sidewalls, a front panel and a back panel, characterized in that said sidewalls of both said bottom part and said top part are made by casting or molding and include integrally formed corners between said sidewalls and said front and back panels and between said sidewalls and their respective bottom and top panels, and further include short flanges extending from said corners perpendicular to the length of the sidewalls and having means shaped to receive the ends of said front and back panels, said front and back panels being separately formed profiled strips, shaped to receive their respective bottom and top panels and to engage said shaped means formed by said short flanges, said bottom and top panels being plates.

2. A suitcase as claimed in claim 1, wherein said front and back profiled strips of said bottom part include a bottom groove provided between integral flanges and an off-set top flange providing a shoulder for the bottom of the front and back top profiled strip.

3. A suitcase as claimed in claim 1 or 2, wherein the sidewalls of said bottom part each include a bottom groove along the side of said sidewall, an off-set top edge providing a shoulder to receive a bottom flange of the respective sidewall of said top part and parallel flanges extending at right angles to said top edge for the height of said wall to receive one end of said profiled strip of said bottom part.

4. A suitcase as claimed in claim 3, wherein said sidewalls of said top part are each made by casting or molding and include an inwardly turned integral bottom flange shaped to engage said shoulder, and said sidewalls of said top and bottom parts are of a single thickness.

* * * * *